US009991594B2

(12) United States Patent
Göttl

(10) Patent No.: US 9,991,594 B2
(45) Date of Patent: Jun. 5, 2018

(54) WIDEBAND ANTENNA ARRAY

(71) Applicant: KATHREIN-WERKE KG, Rosenheim (DE)

(72) Inventor: Maximilian Göttl, Frasdorf (DE)

(73) Assignee: Kathrein-Werke KG, Rosenheim (DE)

( * ) Notice: Subject to any disclaimer, the term of this patent is extended or adjusted under 35 U.S.C. 154(b) by 131 days.

(21) Appl. No.: 14/907,346

(22) PCT Filed: Jun. 26, 2014

(86) PCT No.: PCT/EP2014/001732
§ 371 (c)(1),
(2) Date: Jan. 25, 2016

(87) PCT Pub. No.: WO2015/010760
PCT Pub. Date: Jan. 29, 2015

(65) Prior Publication Data

US 2016/0172757 A1 Jun. 16, 2016

(30) Foreign Application Priority Data

Jul. 24, 2013 (DE) ..... 10 2013 012 305

(51) Int. Cl.
*H01Q 1/24* (2006.01)
*H01Q 21/06* (2006.01)
*H01Q 5/10* (2015.01)

(52) U.S. Cl.
CPC ..... *H01Q 5/10* (2015.01); *H01Q 1/246* (2013.01); *H01Q 21/061* (2013.01)

(58) Field of Classification Search
CPC .... H01Q 1/246; H01Q 21/0006; H01Q 21/06; H01Q 21/061; H01Q 21/062; H01Q 21/24; H01Q 21/26; H01Q 21/28; H01Q 21/29; H01Q 21/30
See application file for complete search history.

(56) References Cited

U.S. PATENT DOCUMENTS 6,211,841 B1 * 4/2001 Smith ..... H01Q 1/246 343/797
7,053,832 B2 * 5/2006 Manzione ..... H01Q 21/065 343/700 MS (Continued)

FOREIGN PATENT DOCUMENTS

CN 101228655 A 7/2008
DE 196 27 015 1/1998

(Continued)

OTHER PUBLICATIONS

English translation of the International Preliminary Report on Patentability and Written Opinion of the International Searching Authority dated Feb. 4, 2016, issued in International Application No. PCT/EP2014/001732.

(Continued)

*Primary Examiner* — Tho G Phan
*Assistant Examiner* — Patrick Holecek
(74) *Attorney, Agent, or Firm* — Nixon & Vanderhye P.C.

(57) ABSTRACT

An improved antenna array is distinguished inter alia by the following features: each of at least two antenna columns contains at least one supplementary antenna element, the at least two supplementary antenna elements are arranged such that the centers of the at least two supplementary antenna elements are arranged with a horizontal lateral spacing (b) that is smaller than the lateral spacing (a) between the centers of the antenna element groups or of the antenna elements in the two antenna columns, the wideband antenna elements in a respective antenna column are fed jointly together with the at least one supplementary antenna element, and a distribution network is provided for the at least one antenna element group with the at least one associated antenna element with an associated filter function (F) for the at least one associated supplementary antenna element, which radiate in a higher frequency subband than the wideband antenna elements.

18 Claims, 10 Drawing Sheets

(56) References Cited

U.S. PATENT DOCUMENTS

| | | | | |
|---|---|---|---|---|
| 7,808,443 | B2 * | 10/2010 | Lindmark | H01Q 1/523 343/815 |
| 9,472,845 | B2 * | 10/2016 | Teillet | H01Q 3/38 |
| 9,570,804 | B2 * | 2/2017 | Shang | H01Q 1/246 |
| 2013/0002505 | A1 | 1/2013 | Teillet et al. | |
| 2014/0111396 | A1 * | 4/2014 | Hyjazie | H01Q 1/52 343/798 |

FOREIGN PATENT DOCUMENTS

| | | |
|---|---|---|
| DE | 197 22 742 | 12/1998 |
| DE | 10 2004 057 774 | 6/2006 |
| DE | 10 2007 060 083 | 6/2009 |
| EP | 1 208 614 | 5/2002 |
| EP | 2 521 218 | 11/2012 |
| WO | WO 2000/39894 | 7/2000 |
| WO | WO 2004/051796 | 6/2004 |
| WO | WO 2004/100315 | 11/2004 |
| WO | WO 2007/042938 | 4/2007 |

OTHER PUBLICATIONS

International Search Report for PCT/EP2014/001732, dated Oct. 1, 2014, 4 pages.
Notification of the First Office Action dated Mar. 5, 2018, issued in Chinese Patent Application No. 201480041515.4.

* cited by examiner

WIDEBAND ANTENNA ARRAY

This application is the U.S. national phase of International Application No. PCT/EP2014/001732 filed 26 Jun. 2014, which designated the U.S. and claims priority to DE Patent Application No. 10 2013 012 305.4 filed 24 Jul. 2013, the entire contents of each of which are hereby incorporated by reference.

The invention relates to a broadband antenna array according to the preamble of claim 1.

Antenna arrays are used in mobile communications base stations, for example. They are used for transmitting and receiving, that is to say for handling communication between a plurality of participants within the relevant phototelegraphic cell. The antennas may have suitable directional characteristics for this purpose. The size of the mobile communications cell may be changed and/or set, inter alia, by differently setting a downtilt angle in terms of the directional characteristics thereof.

A generic antenna array for example comprises two antenna gaps which usually extend so as to be oriented in the vertical direction or predominantly in the vertical direction and are arranged side by side in the horizontal direction. Other such pairs of antenna gaps may be provided as part of the antenna array.

Usually, a plurality of radiator groups are located in each antenna gap so as to be spaced apart above one another in the vertical direction, each radiator group comprising at least one radiator.

These may be single-polarised, dual-polarised or circularly polarised radiators. Here, the radiators themselves are generally positioned in front of a reflector. The various radiators and radiator types, for example dipole radiators, as are disclosed in principle in DE 197 22 742 A or DE 196 27 015 A, could be used. In this case, the dipole radiators may have a simple dipole structure or may consist of a crossed dipole or a dipole square. In this respect, vector dipoles are also known in particular, as are disclosed in WO 00/39894 A1 or WO 2004/100315 A1 for example. For the sake of completeness, patch radiators, which can radiate in a single-polarised or dual-polarised manner, should also be mentioned as another possible example. Furthermore, it is noted that the above-mentioned principle can be used for all the radiator types that are used for group antennas, and thus for example for dielectric radiators, aperture radiators, slot radiators, etc. There are no limitations in this respect.

Monoband antennas and also dual-band antennas or multi-band antennas have also become known in the prior art. Such dual-band antennas often operate in the 900 MHz and 1800 MHz or 1900 MHz band, thus for example in frequency ranges both of from approximately 800 MHz to 1000 MHz and from 1700 MHz to 2200 MHz. For this purpose, radiators that radiate for example in a lower frequency band of around 900 MHz and additionally radiators that radiate in a higher frequency band, for example in an 1800 MHz or 1900 MHz band, are therefore provided.

In the context of recent developments, it has however now also become possible to provide broadband radiators, which are used in particular in a high-frequency range, that is to say for example in a range of from over 1700 MHz to 2700 MHz, for example.

These are thus broadband high-frequency radiators which can transmit and/or receive in a wide, continuous frequency band.

The relative bandwidths of such modern antenna arrays having two antenna gaps, for example, are thus now approximately up to 50%. The broadband radiators (11; 11*a*, 11*b*) are constructed such that they can transmit and/or receive in a frequency band of from 1650 MHz to 2900 MHz, in particular in a frequency band of from 1710 MHz to 2690 MHz. If, for example, broadband antenna arrays are used which can be operated in a range of from 1710 MHz to 2690 MHz or for example in a range of from 698 MHz to 960 MHz, such broadband radiators can cover continuous frequency ranges which, for example, may cover a frequency spectrum of 1100 MHz in the first-mentioned case and may cover a frequency spectrum of 829 MHz in the second-mentioned case.

By means of such radiators, radiator devices and/or radiator groups in at least two antenna gaps or more, much higher data rates can thus be achieved in mobile communications by using such broadband radiators. This is all the more applicable if the individual radiators, radiator devices and/or radiator groups in the individual antenna gaps are generally operated in two perpendicular polarisation planes, these polarisation planes preferably being oriented at an angle of +45° and −45°, respectively, relative to the horizontal or vertical, that is to say said radiators, devices or groups transmit and/or receive in these two orthogonal polarisation planes or are also circularly polarised in a clockwise or counter-clockwise manner or are elliptically circularly polarised.

In order for it to be possible to achieve the highest possible data rates, it is also important for interferences to be kept as low as possible. This requires the side lobes that appear inherently to be suppressed as far as possible as part of the radiation characteristics of the antenna array.

The problem addressed by the present invention is therefore to provide an improved antenna assembly, i.e. an improved antenna array in particular for mobile communications, which has improved radiation characteristics owing to a high level of suppression of interfering side lobes over a wide frequency range.

The problem addressed by invention is solved in accordance with the features specified in claim 1. Advantageous embodiments of the invention are specified in the dependent claims.

It must also be said to be entirely surprising that improved radiation characteristics can also be achieved in very broadband antenna arrays (which have a relative bandwidth of for example over 25% and above) by improved attenuation and suppression of undesired side lobes using comparatively simple means.

It has now been demonstrated that suppressing undesired side lobes also requires the gap distances between the antenna gaps of such broadband antennas to be improved.

Here, in particular in the broadband antenna arrays mentioned, there is the problem that the gap distance between two adjacent gaps in the antenna array is specified in a fixed manner, and specifically by means of the mechanical structure and the mechanical design of the entire antenna assembly. This is disadvantageous in that despite the mechanical gap distance that is specified in a fixed manner, the electrical gap distance between the radiators or radiator groups provided in the individual gaps increases as the frequency increases. This increase is a growing problem particularly in broadband radiators.

According to the invention, an improvement for suppressing the side lobes by optimising the gap distances is made possible in that additional radiators are provided in the at least two antenna gaps that have a fixed mechanical gap distance, i.e. at least one additional radiator is provided in each case and is operated only for a higher frequency band or a frequency sub-band in the broadband frequency spectrum. These auxiliary radiators or auxiliary radiator groups that are only operated in a higher spectrum or sub-spectrum of the entire broadband spectrum are arranged at a smaller gap distance (that is adapted for the higher frequencies) from one another compared with the radiator distance or gap distance at which the individual radiators and radiator groups are otherwise arranged in the individual antenna gaps in the antenna array. In this case, these auxiliary radiators for the high-frequency band or sub-band or for the higher frequency range or frequency sub-range are powered by means of filters, which act as high-pass filters. In other words, the broadband radiators or radiator groups provided per se in an antenna gap in the antenna array and the additional radiators provided in the relevant antenna gap are jointly powered in the comparatively high-frequency sub-spectrum, optionally with phase-shifter devices or members being inserted in order to set a different downtilt angle. The above-mentioned filter for the additional radiator acts as a high-pass filter and also integrates additional radiators for the higher frequencies only at the higher frequencies having a correspondingly adjustable or specified power distribution. In the context of the invention, for a fixed mechanical radiator distance for the broadband radiators, this leads to a more constant electrical radiator distance being achieved over the entire frequency band, that is to say said distance is not so greatly varied in the entire broadband frequency spectrum for the different frequencies, as a result of which the undesired side lobes are considerably reduced. In the context of the invention, the mechanical gap distance between two antenna gaps may for example be between 0.2 and 1.5 times the wavelength, the corresponding wavelength being based on the centre frequency and the centre of the respective radiators that cover the entire broadband frequency range. This range is preferably between 0.4 and 0.8 times the wavelength.

The broadband radiators are radiators which, as mentioned above, have a relative bandwidth of 25% and above, preferably of at least 35%, 40% or even 45%. Relative bandwidths of up to 50% and above are entirely possible and conceivable.

The invention is primarily suitable for high-frequency broadband antenna arrays. The invention may thus preferably be used in a range of above approximately 1700 MHz. However, it is also possible for the invention to be implemented in a comparatively significantly lower frequency range, for example in a frequency band of from 694 MHz to 960 MHz, in particular of from 790 MHz to 960 MHz.

In a particularly preferred embodiment of the invention, it is further provided that the power supply to the high-frequency additional radiators, which are only operated in a high frequency sub-band, can be pre-selected or set differently, in particular in relation to the broadband base radiators. Therefore, all the radiators can be supplied with an identical quantity of power. It is, however, also possible for the additional radiators that radiate in a high frequency sub-band, for example, to be supplied with double the quantity of power as the remaining base radiators. Different electrical gap distances can also be specified and generated as a result.

The antenna array can be designed both for transmit mode and for receive mode. In this case, individual radiators and radiator groups may be provided only for the transmit mode and other radiators and radiator groups may be provided only for the receive mode. The radiators or radiator groups that are provided for the transmit mode and for the receive mode respectively may be constructed identically or may also be constructed differently. This also applies to the number of antenna gaps used.

In principle, a multi-gap, multi-band antenna array which for example comprises two gaps is indeed also known from DE 10 2007 060 083 A1; however, this prior publication does not deal with the suppression of side lobes in broadband antenna devices having a relative bandwidth of greater than 25% for example, in particular of greater than 30% for example or even of greater than 40%, but it instead relates to a dual-band or multi-band antenna assembly in which the radiator devices for a lower band are arranged at a gap distance that is suitable for this band, whereas the additional radiators and radiator devices provided for the higher frequency band are arranged at the narrow horizontal distance that is more suitable for this frequency band. In this case, the assemblies are such that the radiators for the higher frequency band are provided in a quantity that is twice as high as that for the radiators for the lower frequency band, since for example the radiators in the lower frequency band transmit and/or receive in a 900 MHz band and the radiators for the higher frequency band transmit and/or receive in the 1800 MHz band, for example, and reference is explicitly made to this in this prior publication. In addition, the radiators in the higher or lower frequency band are also powered separately.

Lastly, a dual-gap antenna array which is constructed as a monoband array is also known from WO 2004/051796 A1. Radiators, for example dual-polarised radiators, which are arranged above one another in the vertical direction, are arranged in each gap. According to this prior publication, the gap distance, that is to say the distance between the radiators or radiator groups between two adjacent gaps, is intended to be approximately $\lambda/2$ based on the central operating wavelength, it being possible in principle for the gap distance to be in a range of from $0.25\lambda$ to $1.0\lambda$ of the operating wavelength, preferably the central operating wavelength. In order to reduce the horizontal half-power width of the radiators or radiator groups to values below 75° in such a monoband antenna array if necessary, it is provided that, for example, in each case at least one radiator which is powered jointly with all the remaining radiators in an antenna group is not positioned in the same antenna group together with the other powered radiators, but in the other antenna gap. This is thus also a different situation.

The invention is described in greater detail below with reference to embodiments. In the drawings.

Figure 7A:
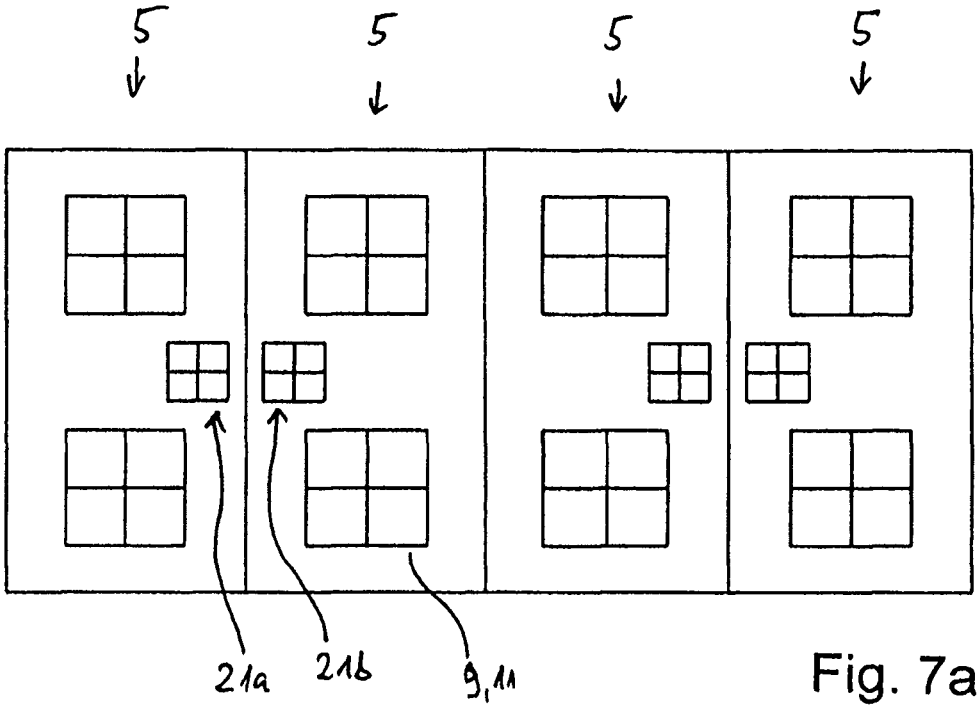
Figure 7B:
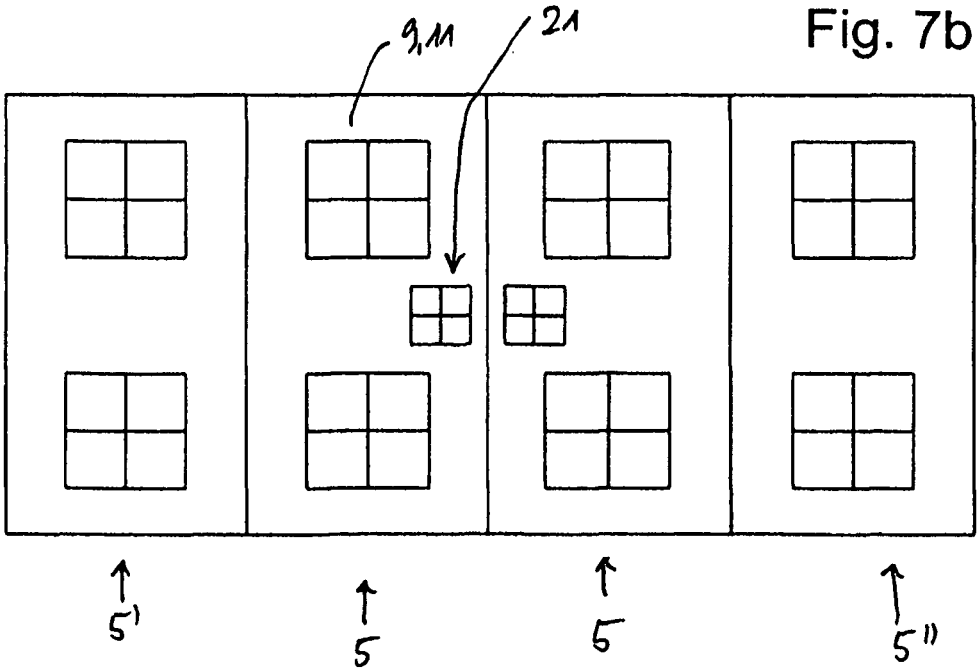
Figure 8A:
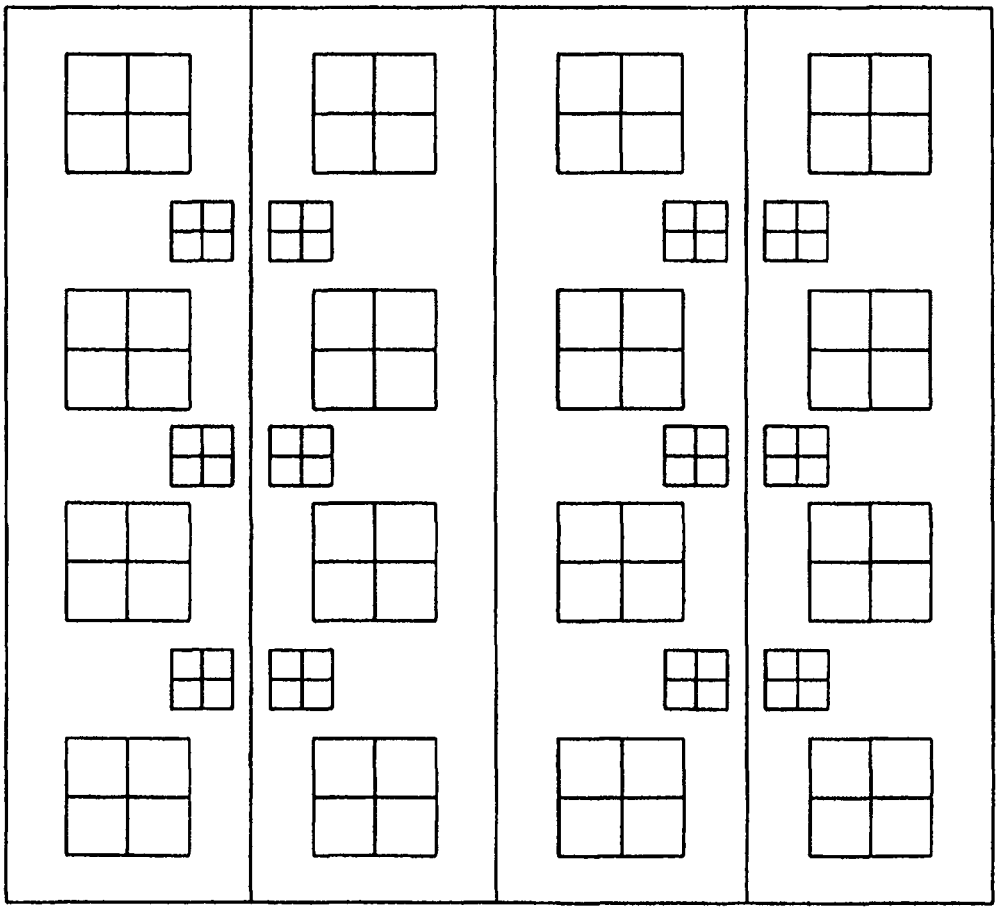
Figure 8B:
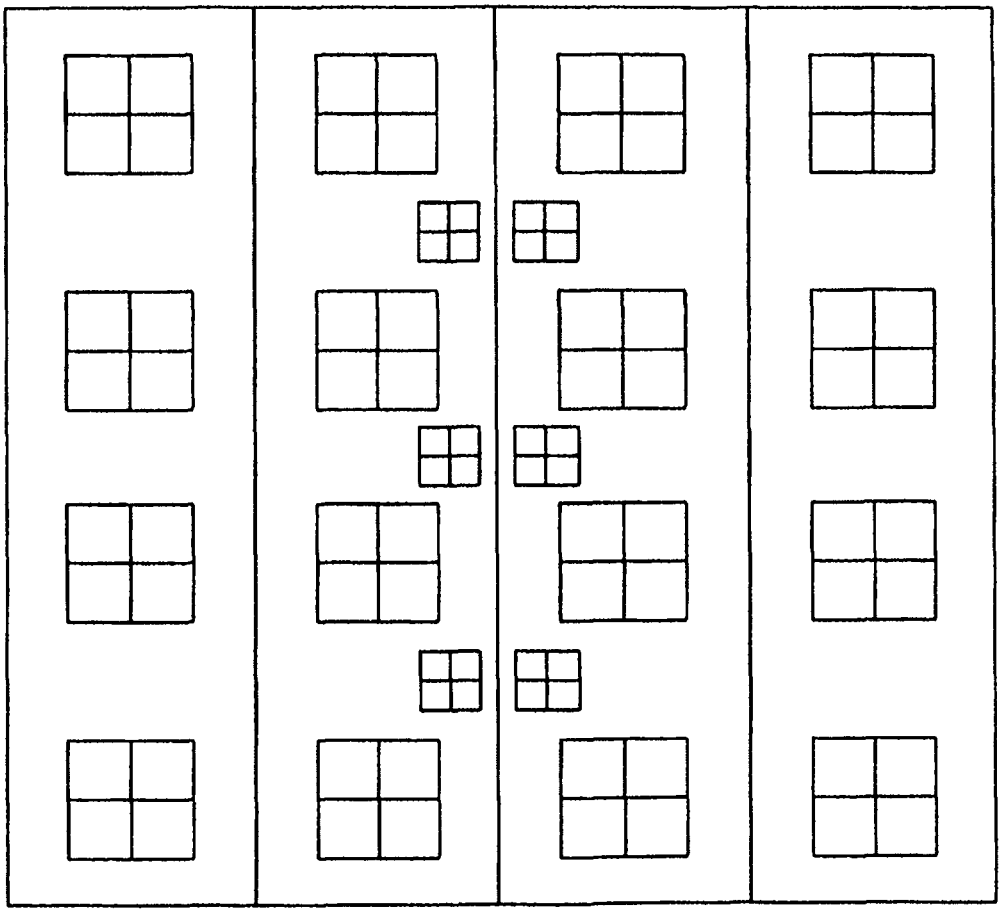
Figure 8C:
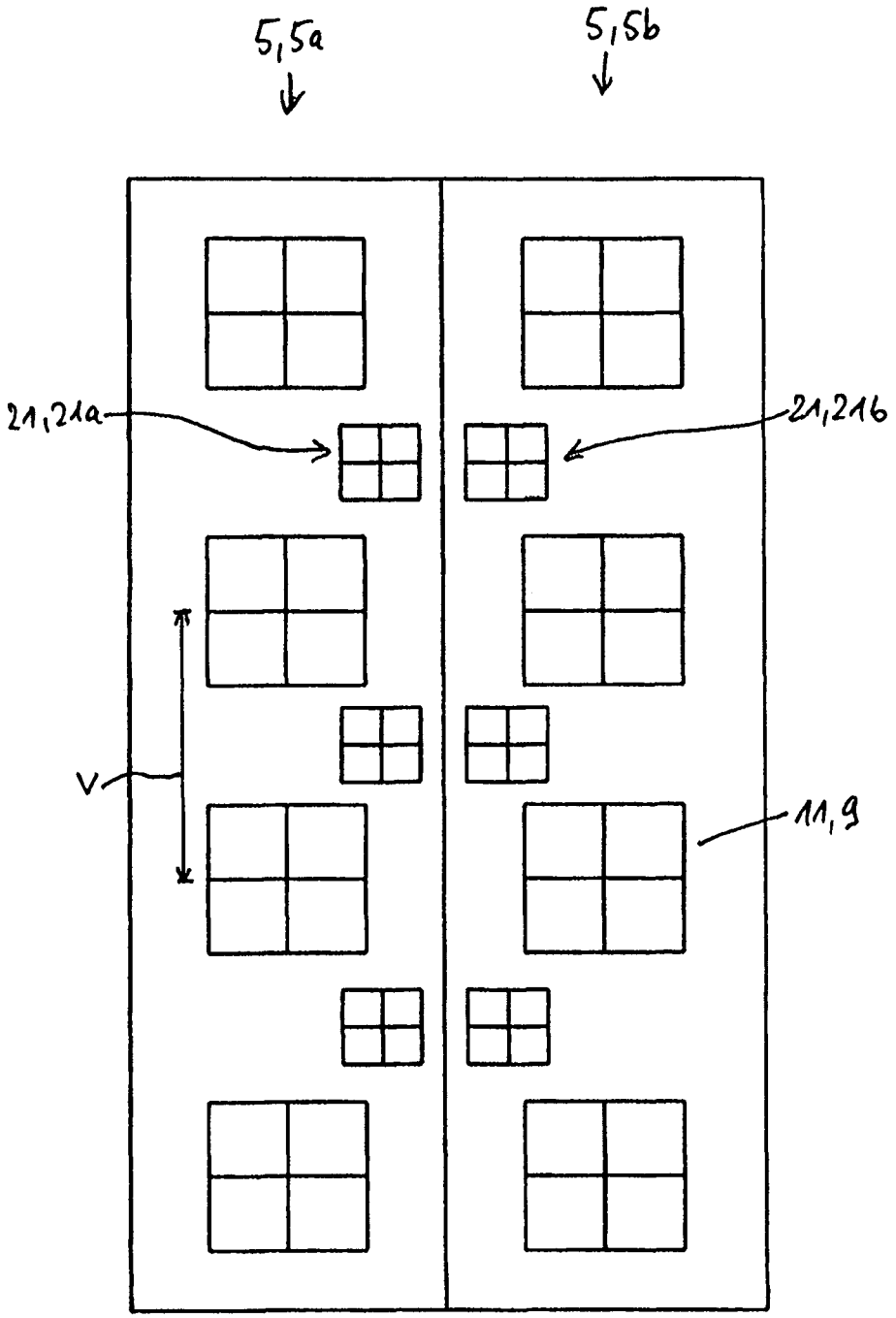
Figure 9:
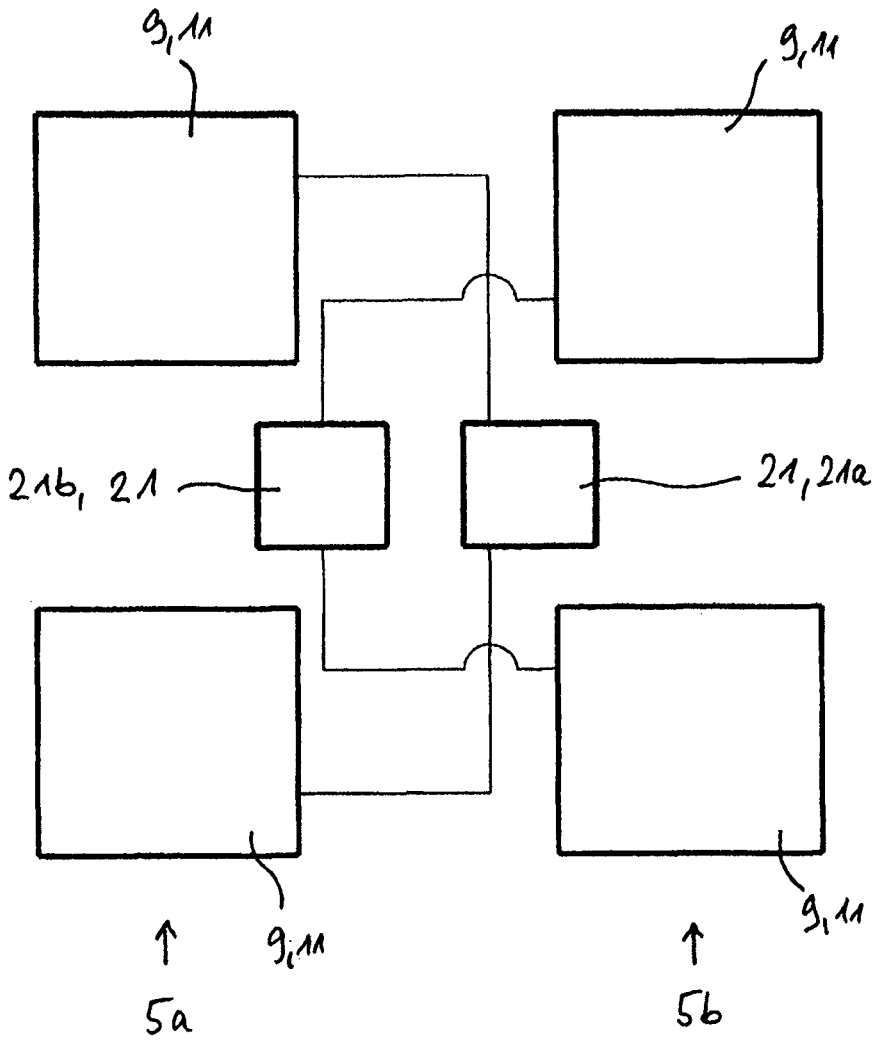
Figure 10:
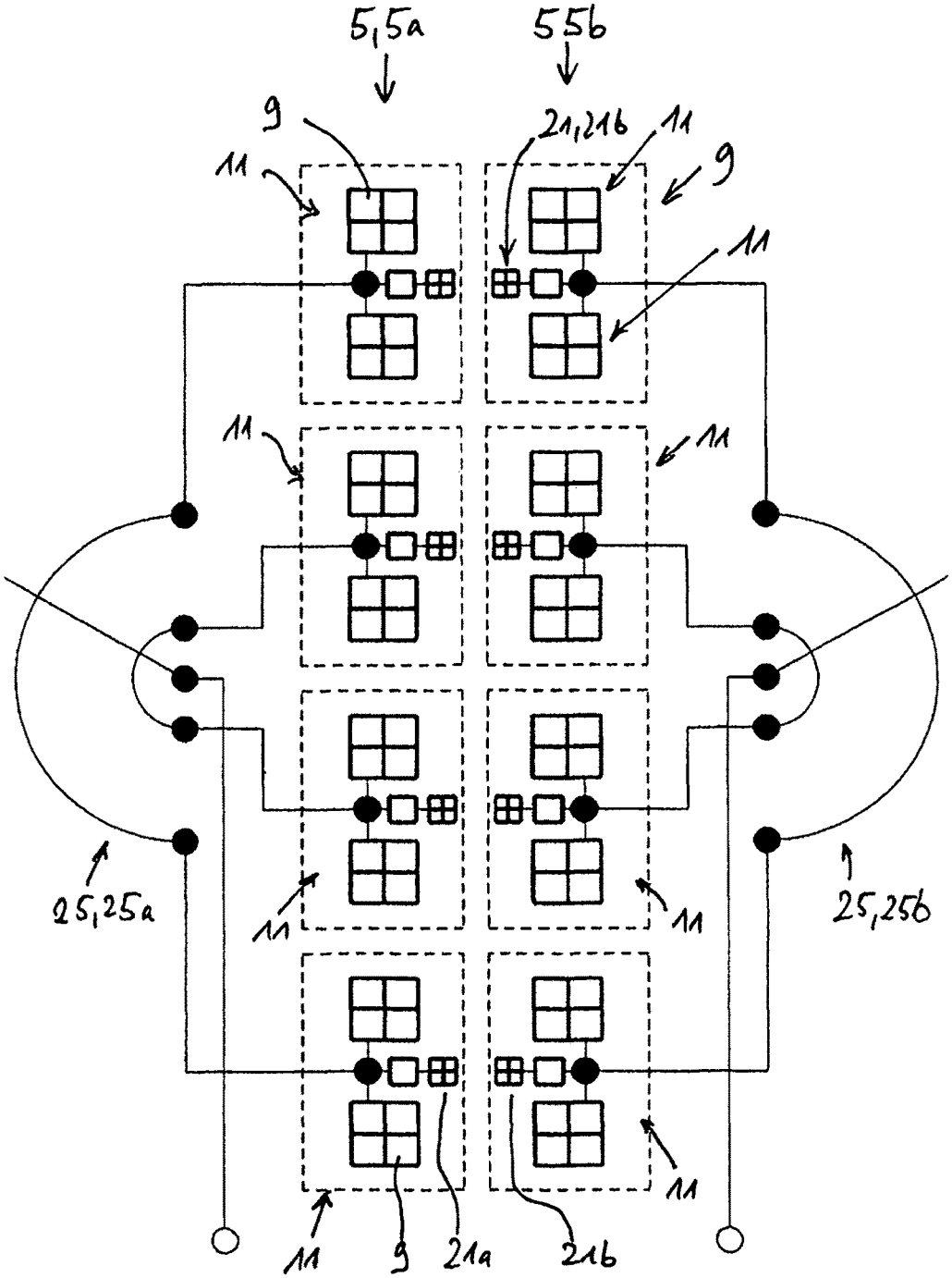

FIG. 7*a* shows an embodiment that is extended compared with FIGS. 1 to 4 for two pairs of antenna gaps (four antenna gaps);

FIG. 7*b* shows an embodiment that is modified compared with FIG. 7*a* in respect of a four-gap antenna array;

FIG. 8*a* shows a modified embodiment in respect of a four-gap antenna array comprising four broadband radiators that are arranged above one another in each case and a plurality of auxiliary radiators in each case;

FIG. 8*b* shows an embodiment that is modified compared with FIG. 8*a* in which the auxiliary radiators are only provided in the two central antenna gaps;

FIG. 8*c* shows an embodiment that is modified compared with FIG. 8*a* in respect of an antenna array having just two gaps;

FIG. 9 shows a modified embodiment in which the electrical interconnection of the individual antenna groups is configured differently from the other embodiments; and FIG. 10 shows another embodiment of a two-gap antenna array having four antenna groups provided in each gap, which groups each comprise two radiators, a filter device and an auxiliary radiator, it also being possible to set the downtilt angle of these radiators differently by means of phase shifters.

Figures 1, 2:
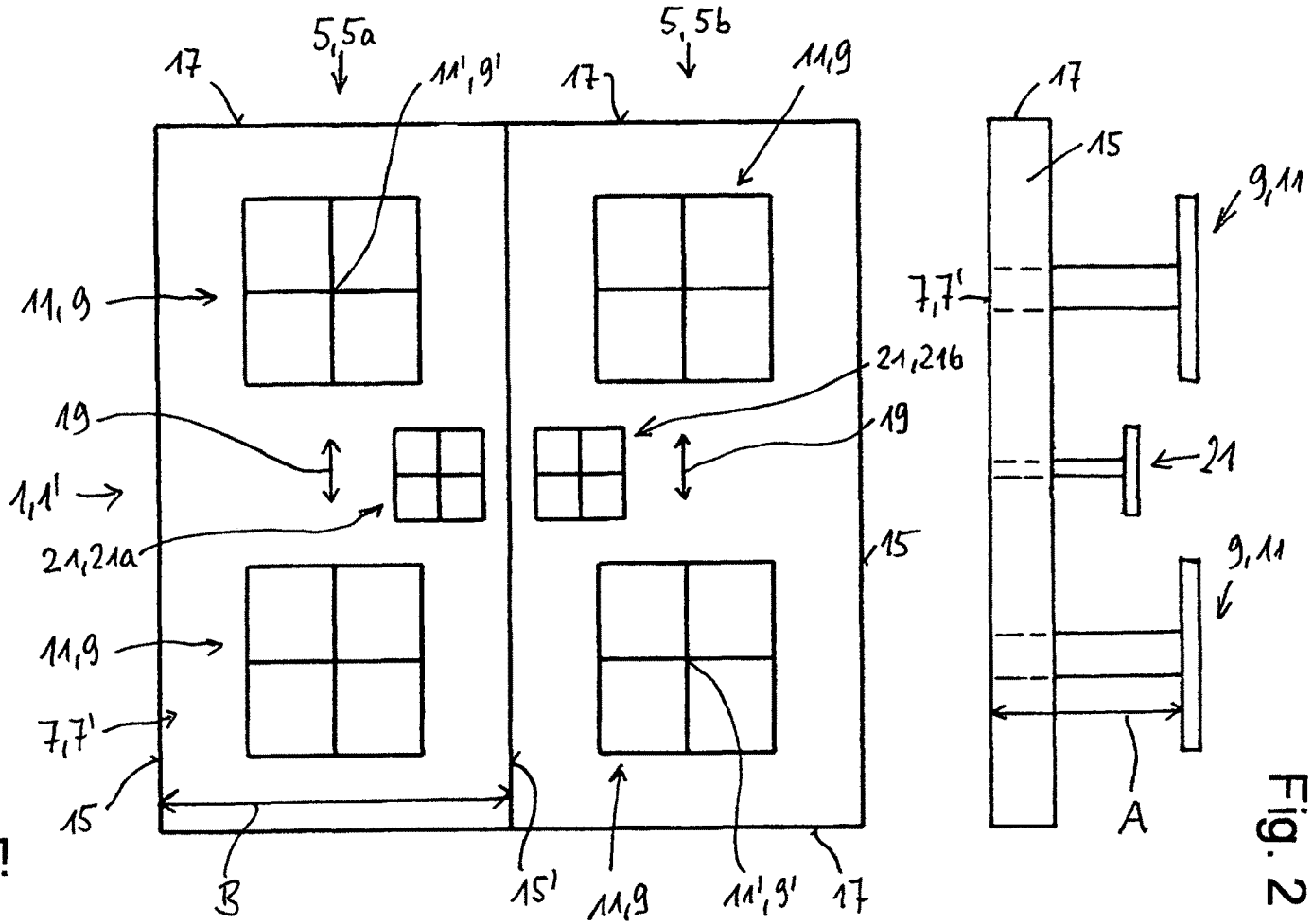
FIG. 1 is a plan view of a first embodiment of an antenna array according to the invention comprising two antenna gaps.
FIG. 2 is a schematic horizontal side view of the antenna array extending in the vertical direction.

FIG. 1 is a schematic plan view of a first embodiment of the invention. The mobile communication antenna 1 that is shown in FIG. 1 and is in the form of an antenna array 1' comprises e.g. two antenna gaps 5, 5*a*, 5*b* which usually extend so as to be oriented in the vertical direction or predominantly in the vertical direction. In this case, the mobile communication antenna 1 may also be oriented so as to be slightly inclined to a greater or lesser extent relative to the vertical, for example. In addition, phase-shifter devices are usually provided not only to specify a downtilt angle in a fixed manner in mechanical terms, but also to be able to set the angle differently and thus in a variable manner by altering the phase-shifter elements if necessary. In this respect, reference is made to known solutions.

Such an antenna array 1' usually comprises a reflector 7 which then extends vertically or at least approximately vertically in accordance with the preferred vertical orientation of the antenna array. The radiators or radiator groups shown in FIG. 1 are then arranged in front of this reflector 7.

In the embodiment shown, a radiator group 9 which consists of at least one radiator 11 or comprises at least one radiator 11 is provided in the left-hand and also in the right-hand antenna gap 5, i.e. 5*a*, 5*b*, so as to be at a vertical distance above one another in each case.

In the embodiment shown, two radiator groups 9 are provided in the two antenna gaps 5 in each case, which groups each contain around one radiator 11 which may be designed as a single-polarised or dual-polarised radiator, for example. Preferably, vector radiators are used, which can be operated in a dual-polarised manner. Such vector radiators are known for example from the prior publications WO 00/39894 A1 or WO 2004/190315 A1. In plan view, these vector radiators may at least approximately or rudimentarily have a square shape, the radiator elements or radiator surfaces that extend in the shape of a square being arranged at a distance A from the reflector 7 and generally being galvanically or capacitively anchored to the reflector by means of a corresponding antenna base and/or a symmetry 13 (FIG. 2). In this case, the reflector may also consist of a printed board, which can be coated with a corresponding electrically conductive layer in the form of a metallic coating.

FIG. 2 is a schematic side view of the antenna array according to FIG. 1. It can also be seen in this figure that the antenna gaps or the reflector 7 may be surrounded or defined by connecting pieces 15 that are raised from the reflector plane 7' and are oriented perpendicularly to or so as to be inclined relative to the reflector plane 7'. Such connecting pieces may also be designed as dividers 15' between the two antenna gaps 5*a* and 5*b* shown. In addition, an upper and lower connecting piece 17 which horizontally defines the antenna gaps may also be provided.

It can also be seen from FIGS. 1 and 2 that the radiator groups or radiators 9, 11 are arranged at a specified vertical distance from one another in a vertical attachment direction in each antenna gap 5, that is to say in particular the centres 9' of the radiator groups 9 and the centres 11' of the radiators 11. In this case, these centres 9', 11' are positioned in the centre of the respective antenna gaps 5; this is preferable, but not compulsory.

It can also be seen from FIG. 1 that the width B of the two antenna gaps is the same. Furthermore, it can be seen from FIG. 1 that the central connecting piece 15', that extends in a vertical plane, between the two antenna gaps 5*a*, 5*b* simultaneously forms a plane of symmetry SE oriented perpendicularly to the reflector plane 7', relative to which plane the two antenna gaps 5*a*, 5*b* are formed and arranged, and specifically including the broadband radiator 11 and/or the broadband radiator group 9 and also the auxiliary radiator 21, which is explained in more detail below. It is noted at this point, however, that the radiator groups 9 and/or the one or more radiators 11 (and also the auxiliary radiators 21 explained in more detail below) provided in the radiator groups cannot always necessarily be arranged on the same elevation line. If said radiators are at a corresponding distance from one another, they can nevertheless be positioned in the respective antenna gaps so as to be offset in the vertical direction.

Figure 3:
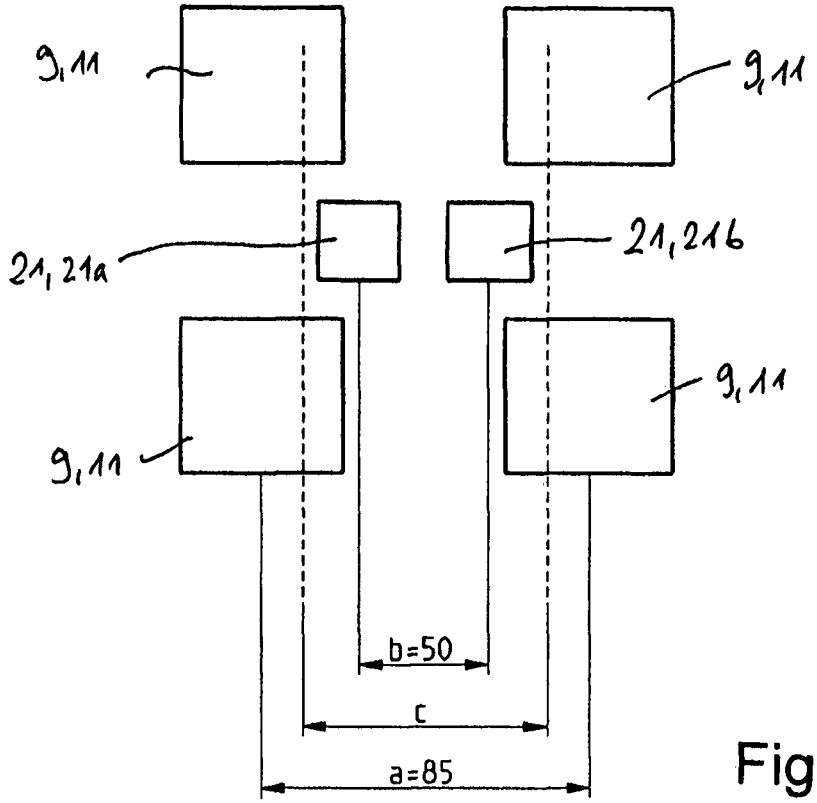
FIG. 3 is a view that is based on the embodiment according to FIGS. 1 and 2 for showing the mode of operation of the embodiments according to the invention.

In the following, reference is made to FIG. 3, in which the respective radiator groups and/or broadband radiators are shown in a similar manner to the previous embodiment (but without showing the individual antenna gaps or the boundaries thereof). FIG. 3 merely serves to better illustrate the mode of operation. It can be seen therefrom that the centres 9', 11' of the radiator groups 9 and of the radiators 11, relative to the radiators arranged in the respectively adjacent antenna gap, are positioned at a distance a, and when the antenna gaps are oriented vertically, are thus positioned at a horizontal distance a from one another that is preferably between 0.25λ and 1.0λ, e.g. about λ/2 based on the central operating wavelength. In the following, this horizontal distance a between the centres of the radiator groups 9 or radiators 11 in the two adjacent antenna gaps 5 is taken as a starting point, even if the centres of the radiator groups or radiators are not positioned exactly on the same elevation line but in a different vertical position.

If it is assumed that the above-mentioned broadband radiators 11 are intended to radiate in a frequency range of from 1710 MHz to 2690 MHz for example, a value of $$a=85\text{ mm},$$

which is shown in FIG. 3, can be selected as the gap distance, i.e. as the distance between the centres between two radiators or radiator groups in two adjacent antenna gaps. This value lies within a preferred range of from 0.25λ to 1.0λ, as is generally standard.

If this gap distance (horizontal distance a between the centres of the radiator groups 9 or the radiators 11 between two adjacent antenna gaps 5) that is specified by the mechanical design of the mobile communication antenna is used, then the following values result:

Gap Distance 85 mm at Various Frequencies:

| | f = 1710 MHz | f = 2170 MHz | f = 2690 MHz |
|---|---|---|---|
| Wavelength | 175 mm | 138 mm | 112 mm |
| Relative gap distance | 0.486 λ | 0.615 λ | 0.759 λ |

It is clear therefrom that in such broadband radiators 11, the optimum gap distance cannot be achieved, since it changes significantly over the wide frequency range. In other words, the relative gap distance that is relevant to the radiation pattern varies based on the wavelength λ owing to the very wide bandwidth of the antenna.

Here, it should furthermore be assumed that the radiators 11 shown in FIGS. 1 and 3 which are arranged in the left-hand antenna gap 5*a* are jointly powered, just as the radiators 11 which are arranged in the right-hand antenna gap 5*b*, which are also jointly powered, and specifically are each jointly powered according to polarisation (it being possible for the individual radiators or radiator groups that are positioned above one another to also be settable so as to have different phase positions, despite being jointly powered, by means of phase members and variably settable phase members such as phase shifters, in order for it to be possible to set different downtilt angles).

In order to now reduce the undesired side lobes, the invention provides that at least one auxiliary radiator 21, i.e. 21*a* or 21*b*, which is also single-polarised, dual-polarised or circularly or elliptically polarised, is inserted per antenna gap 5, corresponding to the radiators 11, which are also single-polarised, dual-polarised or circularly or elliptically polarised.

The auxiliary radiator 21*a* in the first antenna gap 5*a* is also powered jointly with the other broadband radiators 11 in the first antenna gap 5*a*, as well as the other auxiliary radiator 21*b* in the second antenna gap 5*b* being powered jointly with the broadband radiators 11 provided in the second antenna gap 5*b*. These auxiliary radiators 21*a* and 21*b* are, however, only intended to transmit and/or receive in a higher frequency sub-range or the frequency sub-band preferably of the broadband frequency range (frequency band) in which the radiators 11, which are sometimes also referred to as broadband base radiators 11, are also intended to transmit and/or receive. In other words, these auxiliary radiators 21, that is to say those referred to as auxiliary radiators 21, are not intended to be powered at low frequencies. These auxiliary radiators 21 are arranged in each case at a short distance, in particular a horizontal distance b (b specifying the distance between the centres 21'*a* and 21'*b* of the respective auxiliary radiators 21*a* and 21*b*), from one another, one auxiliary radiator 21 being assigned to or positioned in the left-hand antenna gap 5*a* and the second auxiliary radiator 21 being assigned to or positioned in the right-hand antenna gap 5*b*.

This distance b may for example be from 70 mm to 30 mm. In the embodiment shown, a value of b=50 mm is assumed, for example.

These auxiliary radiators 21 which are powered in each gap jointly with the radiators 11 provided therein then cause the phase centres of both gaps to shift towards the auxiliary radiators 21, i.e. inwards towards one another in each case. Therefore, the corresponding ratios, as are described in principle on the basis of FIG. 4, are reproduced again in the representation according to FIG. 3, the individual antenna gaps not being shown in FIG. 3 for the purposes of improved clarity. In the embodiment described, the resulting phase centres are then located on the dashed lines ResPh shown in FIG. 3, this distance being denoted by c in FIG. 3. This distance c is thus determined by the geometric distances between the centres of the radiators 11 or of the radiator groups 9 in the respectively adjacent antenna gaps 5, by the number of respective radiators 11 and auxiliary radiators 21 and by the power of the respective radiators 11 and auxiliary radiators 21.

The influence that the power (which can also be implemented differently or can be predetermined or set differently) for the individual radiators has on the resulting phase centres is found in the table below for example:

Distance Between the Phase Centres Together with Additional Radiators at the Highest Frequency:

| Power distribution | Distance between the phase centres | f = 2690 MHz |
|---|---|---|
| 1:1:1 | (50 mm + 2 × 85 mm)/3 = 73.7 mm | 0.65 λ |
| 1:2:1 | (2 × 50 mm + 2 × 85 mm)/3 = 61.7 mm | 0.55 λ |

It can therefore be seen therefrom that a different power distribution in terms of the power supplied to the auxiliary radiators 21 relative to the broadband radiators 11 also likewise contributes to a change in the electrical half-power width of the antenna array, which is a dual-gap antenna array in the embodiment shown. Therefore, for example, the broadband radiators 11 as well as the auxiliary radiators 21 may be supplied with the same power or the same amplitude. It is for example also possible for the auxiliary radiators to be supplied with a higher power or higher amplitudes than that of the broadband radiators, for example supplied with double the power. It would also be possible for the auxiliary radiators to be supplied with a lower amount of power or a lower amplitude than that of the broadband radiators. Then, however, the desired effect in terms of a reduction in the electrically effective gap distance between the antenna gaps would also be lower, and this is generally not desired.

Figure 4:
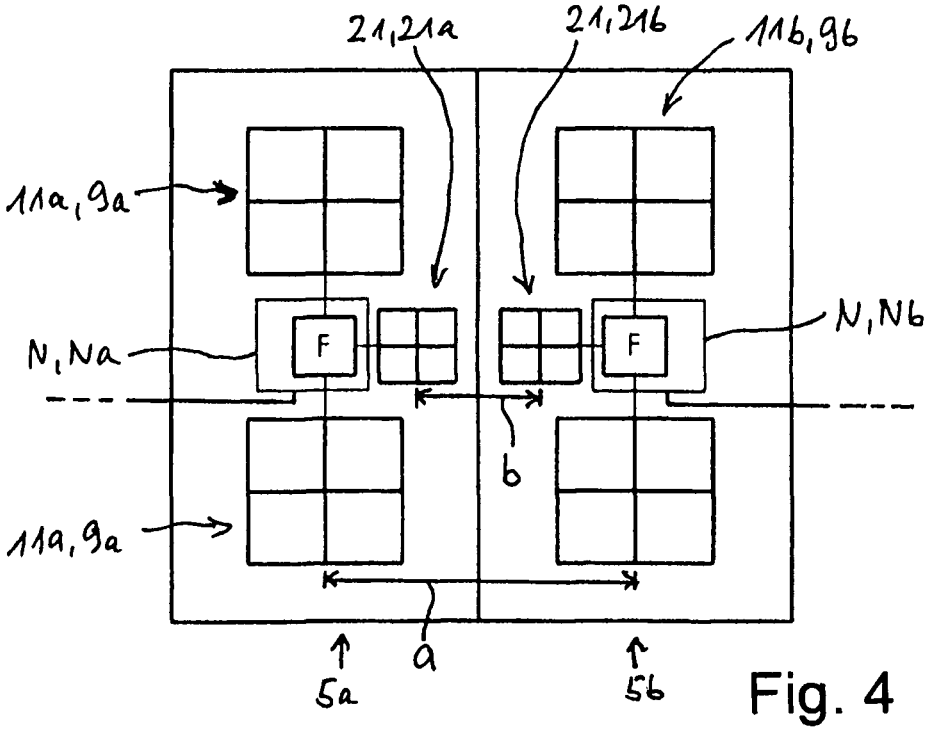
FIG. 4 is a view corresponding to FIG. 2 additionally showing filters, preferably in the form of a bandpass filter for powering the auxiliary radiators provided in each antenna gap only in a higher frequency sub-band.

In order to thus cause side lobes to be suppressed by using the above-mentioned auxiliary radiators 21, these auxiliary radiators 21 are then provided upstream of a filter function or a filter F independently of one another in the respective antenna gaps 5*a* or 5*b*, as is shown in principle in FIG. 4. Here, the filter F acts in each case as a high-pass filter or bandpass filter, or as a band-stop filter for lower frequencies, and integrates the auxiliary radiators for the higher frequencies with a desired power distribution. As a result, when a fixedly predetermined mechanical radiator distance a is provided for the broadband radiators, a more constant electrical radiator distance can be achieved over the entire frequency band and more constant, smaller side lobes are thus generated over the frequency band which result in better interference reduction and thus produce a higher data rate.

The filter function F, i.e. in particular the above-mentioned filter F, in particular for powering the auxiliary radiators 21 in a frequency band or a frequency sub-band that is higher compared with the broadband frequency band which is transmitted and/or received by means of the broadband radiators 11, is preferably part of a distributed network or distribution network N, a distribution network Na being provided for the jointly powered broadband radiators 11*a* and the at least one associated auxiliary radiator 21*a* and a distribution network Nb being provided for the jointly powered broadband radiators 11*b* and the at least one associated auxiliary radiator 21*b*. In this case, for each of the above-mentioned groups of broadband radiators and auxiliary radiators, each distribution network Na and Nb can again be designed to be separate for the respective polarisations of the preferably dual-polarised radiators. In this respect, reference is made to known and standard methods and solutions.

The above-mentioned broadband radiators 11, i.e. 11*a* and 11*b*, are broadband radiators which can transmit and/or receive at a relative bandwidth of preferably greater than 25%, in particular of greater than 30%, 35%, 40% or even of greater than 45% (in extreme cases even of greater than 50%). Particularly in such broadband radiators, there is the problem of undesired secondary-lobe formation, the development or influence of which is intended to be prevented or significantly reduced in terms of its effect within the context of the invention.

If, in the above-mentioned embodiment, it is assumed for example that the broadband radiators 11*a*, 11*b* in the first and second antenna gap 5*a*, 5*b* each radiate in a frequency band of from 1710 MHz to 2690 MHz, then the filter group F provided upstream of the auxiliary radiators 21 ensures that these auxiliary radiators 21*a* and 21*b* only radiate, i.e. transmit and/or receive, in a frequency sub-band of for example from 2300 MHz to 2690 MHz (or for example only in a frequency sub-band of from 2500 MHz to 2690 MHz). In this case, the radiators 9' in each antenna gap 5 are powered jointly with the planar, corresponding one or more auxiliary radiators 21, a higher frequency sub-band only being assigned to the relevant auxiliary radiator 21 in the transmit mode and/or receive mode by the above-mentioned filter F, which is preferably in the form of a bandpass filter. Despite the joint power supply, phase control elements, in particular variable phase control elements, may however then be provided between the individual radiators 11 or radiator groups 9 that are arranged above one another, in order for it to be possible to set a different downtilt angle despite the joint power supply to the radiators in the respective antenna groups.

It can be seen from the ratios described that the frequency ranges broadcast by the auxiliary radiators are broadcast at a centre frequency $f_H$ that is higher than the centre frequency $f_T$ in respect of the broadband frequency range which is broadcast and received by the broadband radiators 11. In the embodiment shown, the frequency sub-band broadcast at the higher centre frequency $f_H$ overlaps with the entire broadband frequency band broadcast at a comparatively lower centre frequency $f_H$.

Figure 5:
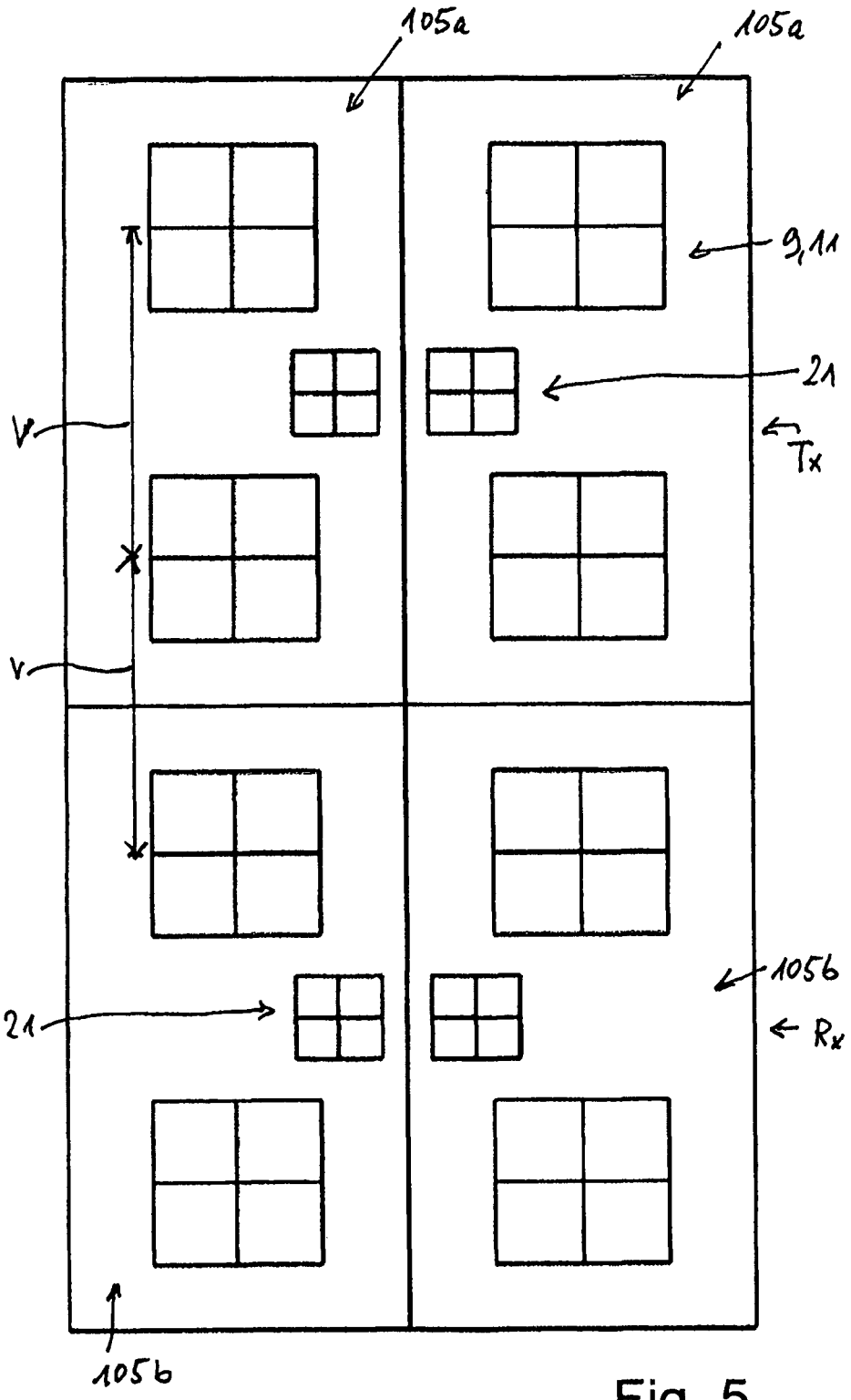
FIG. 5 shows an extended embodiment according to the invention having separate radiators for the transmit mode and receive mode.

On the basis of FIG. 5, a variant is shown in which four radiator groups 9 that each have one radiator 11 are arranged in the left-hand and in the right-hand antenna gap 5*a*, 5*b* respectively, and specifically, as in the above embodiments, also with a regular vertical distance v between the adjacent centres 9' and 11' of the radiator groups 9 and the radiators 11 respectively. For the two upper radiator groups 9 and for the two lower radiator groups 9 (which, in the embodiment shown, only comprise one dual-polarised radiator 11 in each case), an auxiliary radiator 21, i.e. 21*a* and 21*b*, which transmits and/or receives in the high-frequency frequency sub-band is in each case preferably provided centrally between said upper and lower radiator groups and so as to be offset towards the respectively adjacent antenna gap.

In this case, the antenna assembly in this embodiment is such that the radiators or radiator groups 11, 9 in the two upper regions or halves 105*a* of the antenna gaps 5 are provided for the transmit mode TX and the radiators and radiator groups 11, 9 in the two lower regions or halves 105*b* of the antenna gaps 5 are provided for the receive mode RX. Otherwise, radiators for each half of the entire antenna array the design as explained on the basis of FIGS. 1 to 4, the radiators 11 for the transmit mode in one antenna gap 5 always being powered jointly, for each polarisation, with the at least one or more auxiliary radiators 21 that are provided in said antenna gap in each case.

Figure 6:
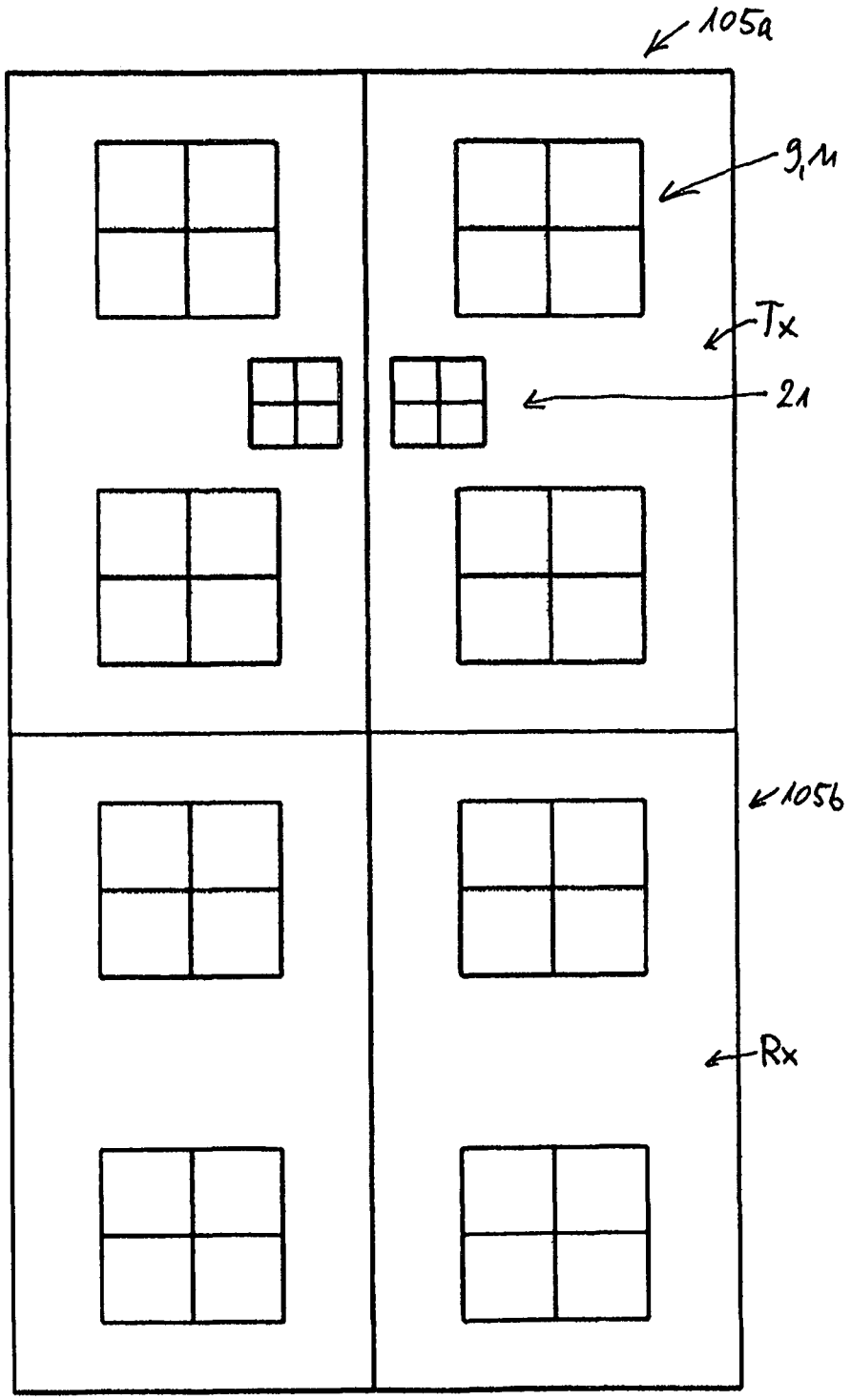
FIG. 6 shows an embodiment that is slightly modified compared with FIG. 5.

FIG. 6 has been modified with respect to FIG. 5 inasmuch as the auxiliary radiators 21 that have been mentioned and explained above are provided only in the upper half 105*a* for the transmit mode Tx in order to change the effective horizontal distance between the antenna gaps or the centres of the radiators. With respect to the broadband radiators 11 (or radiator groups 9 having the broadband radiators 11) that are provided in FIG. 6 in the two antenna gaps 5*a*, 5*b* in the lower region, i.e. the lower half 105*b*, additional auxiliary radiators 21 are not provided in the antenna gaps for the receive mode Rx.

With reference to FIG. 7*a*, it is merely explained that the embodiment according to FIGS. 1 and 2 can also be doubled inasmuch as each two pairs of two antenna gaps 5*a*, 5*b* in each case are provided in an extended manner so as to be positioned side by side in the horizontal direction.

In the variant according to FIG. 7*b*, the mobile communication antenna according to the invention having the two antenna gaps is formed and provided in the centre in accordance with the design according to FIGS. 1 to 4, another additional antenna gap 5' and 5", which is conventionally (as is also the case in the prior art) operated without auxiliary radiators 21, being provided on the outside in each case.

FIG. 8*a* then shows an extended embodiment, in which for example two pairs of antenna gaps 5*a*, 5*b* are provided which are arranged side by side in the horizontal direction.

In this embodiment, four radiator groups 9 are arranged in each antenna gap so as to be above one another in the vertical direction in an arrangement that is at a distance from the corners. In this variant too, each radiator group 9 only comprises just one radiator 11, preferably a dual-polarised radiator, for example in the form of the vector dipole known from the prior art.

Between each two radiators or radiator groups 11, 9 which are arranged above one another (in front of an associated joint reflector), an auxiliary radiator 21 is preferably arranged centrally therebetween in each case and so as to be offset towards the respectively adjacent antenna gap 5. When n radiators or radiator groups 11, 9 are arranged above one another, n−1 auxiliary radiators 21 are thus provided in each antenna gap 5. Otherwise, the mechanical design and the electrical mode of operation in respect of the two left-hand antenna gaps 5*a* and 5*b* shown in FIG. 8*a* and the associated radiators and the electrical mode of operation in respect of the two right-hand antenna gaps 5*a* and 5*b* shown in FIG. 8*a* together with the broadband radiators 11 and auxiliary radiators 21 provided therein are similar to the embodiment described with reference to FIGS. 1 to 4.

FIG. 8*b* shows a corresponding modification compared with FIG. 8*a*, which is similar to the modification of FIG. 7*b* compared with FIG. 7*a*. Here, in the design described, the above-mentioned auxiliary radiators 21 are thus accordingly additionally arranged only with respect to the two central antenna gaps.

In FIG. 8*c*, the corresponding design is reproduced in a similar manner to that in FIG. 8*a*, the antenna array only comprising two antenna gaps 5 in this embodiment, and specifically having the n−1 spaced-apart radiators or radiator groups 11, 9 which are positioned along an attachment line 19 and the auxiliary radiators 21 which are positioned in each antenna gap in a corresponding attachment line 19', these two attachment lines 19, 19' and thus the centres of these auxiliary radiators 21 being arranged at a shorter distance b from one another, that is to say asymmetrically to the central longitudinal plane in a particular antenna gap.

FIG. 9 merely shows that the relevant auxiliary radiator 21 for each antenna gap may also be powered in the reverse manner to the above-mentioned embodiments. In the variant according to FIG. 9, the electrical interconnection of the radiators 11 and the radiator groups 9 and the positioning of the auxiliary radiators 21 differ, since in this embodiment it is provided that the broadband radiators 11 provided together with the on the left in FIG. 9 (in the left-hand antenna gap 5*a*) are powered jointly with the auxiliary radiator 21*a*, as is also the case in the other embodiment, this jointly powered auxiliary radiator 21*a* being positioned in the other antenna gap, namely in the antenna gap 5*b*, however (the filter devices for ensuring that the auxiliary radiators can only transmit and/or receive in a frequency sub-range of the entire broadband frequency range not being shown). The same applies in reverse to the auxiliary radiator 21*b* that is on the left in FIG. 9 and is positioned in the left-hand antenna gap 5*a*, although it is powered jointly with the broadband radiator positioned in the right-hand antenna gap 5*b*.

Owing to the large resulting lateral offset between the auxiliary radiators 21 in the two antenna gaps 5, 5*a*, 5*b* that is explained with reference to FIG. 9, a correspondingly large shift in the phase centre is brought about.

Lastly, reference is made to an embodiment according to FIG. 10.

This relates to an antenna array 1', preferably for a mobile communication antenna 1, in which four radiator groups 9 are arranged in each case at the same distance from one another in the attachment direction 19 in the two antenna gaps 5, 5*a*, 5*b* provided. On the basis of this example, it is demonstrated that each of these radiator groups 9 may for example comprise more than one radiator 11. In the embodiment shown according to FIG. 11, each radiator group 9 for example comprises two radiators 11, which are powered jointly and in a cophasal manner in each case (it also being possible, however, for three or even more radiators to be provided in each radiator group or for said radiators to only be provided in some of the radiator groups, and it being possible in this case for the additional radiators belonging to a radiator group 9 not only to be positioned above one another in the vertical attachment direction but also, if necessary, to additionally be positioned in a common antenna gap so as to be side by side in the horizontal direction).

In the embodiment shown, an auxiliary radiator 21 is provided for each of the radiator groups 9 and, with a filter F being inserted, is also powered jointly with the radiators 11 belonging to the same radiator group 9 in each case, that is to say also in a cophasal manner, provided that another additional phase-shift member is not provided.

Furthermore, it is also indicated with reference to FIG. 10 that each radiator group 9 that is offset in the vertical direction can be powered at a different phase position by means of phase-shifter devices 25, for example a double phase shifter 25*a*. In other words, all the radiators 11 and auxiliary radiators 21 in each antenna gap are thus powered jointly for each polarisation; however, this does not exclude the possibility that different phase positions can be set in each case for the different radiators or radiator groups that are positioned above one another in the vertical direction. In this respect, reference is made to known solutions for setting a downtilt angle, for example to the prior publication EP 1 208 614 B1.

A corresponding design using a phase shifter 25, i.e. 25*b*, the phase position for the radiators 11 and auxiliary radiators 21 provided in the double antenna gap 5, 5*b* may also be set differently for said double antenna gap.

In this embodiment, a variable downtilt angle may thus be set in addition to the solution according to the invention.

In principle, within the context of the invention explained above, the individual patterns and thus also the diversity and the MimO applications can thus be significantly improved compared with conventional solutions. The use of the auxiliary radiators leads to the radiation pattern being achieved in a more constant manner, in particular by means of the desired secondary-lobe suppression, which side lobes otherwise occur in solutions according to the prior art. The lateral offset of the position of the auxiliary radiators 21 (in each case, the corresponding auxiliary radiators 21 defined in the antenna gaps being arranged at a shorter distance b from one another than the other radiators or radiator groups 11, 9) results in a significant improvement in the beamforming mode, i.e. the base station actuates the two antenna gaps 5, 5*a*, 5*b* such that variable beam sweeping or a change in the half-power width can also be achieved in the horizontal plane.

In summary, specific features of the invention and preferred variants may include the following features and/or ranges, namely:

- The above-mentioned antenna array may consist of two gaps or of a plurality of assemblies which each preferably comprise two gaps.
- The antenna array has broadband radiators for the broadband range and radiators for a comparatively higher and generally narrower frequency range, which overlap, overlap in part or do not overlap completely.
- The antenna array contains one or more filters, the filters provided in particular for the auxiliary radiators being integrated in a distribution network having a corresponding filter function.
- The above-mentioned filters may be in the form of high-pass filters or band-stop filters, bandpass filters, or may be designed using other suitable measures, in order to select or suppress the desired frequencies.
- The mechanical gap distance between antenna gaps may for example be from 0.2 to 1.5 wavelengths based on the centre frequency or the centre of the broadband radiators, which wavelengths cover the broadband frequency range in particular in the form of the entire broadband frequency range. The corresponding gap distance may therefore preferably be from 0.4 to 0.8 wavelengths.
- In the above-mentioned distribution network, the radiators may be powered and/or operated using the same power distribution or a different power distribution.
- By means of the distribution network and/or the filter functions, the broadband radiators may be powered or operated using the same power distribution, and the auxiliary radiators for the higher frequency band or the higher frequency sub-band may be powered or operated using the same or a higher power.
- The above-mentioned distribution network may be designed as a printed board.
- The distribution network may also be designed using cables and filters.
- The distribution network may also be designed in a hybrid manner using a printed board and cables.

The antenna array may comprise broadband radiators and/or auxiliary radiators for the transmit mode (Tx) and for the receive mode (Rx) which are designed separately.

The antenna array may be constructed identically or differently both for the transmit mode (Tx) and for the receive mode (Rx).

The antenna array may comprise a different number or an identical number of gaps for the transmit mode (Tx) and the receive mode (Rx).

The antenna array preferably comprises dual-polarised radiators which are designed and/or positioned in the manner of an X polarisation such that the polarisation planes come to rest at a +45° and −45° angle to the horizontal and the vertical, respectively.

The auxiliary radiators not only bring about an improvement in the radiation pattern in the horizontal plane, but also bring about a frequency equalisation of the vertical radiation pattern.

The invention claimed is:

1. Antenna array, in particular for mobile communications, comprising:

at least one pair of antenna columns which are oriented so as to extend in the vertical direction or predominantly in the vertical direction and are positioned side by side in the horizontal direction, at least one radiator group having at least one radiator arranged in at least two antenna columns in each case, which radiator is configured to transmit and/or receive in a single-polarized, dual-polarized or circularly or elliptically polarized manner, the at least one radiator being designed as a broadband radiator such that it can transmit and/or receive electromagnetic signals at a relative bandwidth of ≥25%, at least one auxiliary radiator provided in at least two antenna columns in each case, the at least two auxiliary radiators being arranged such that the centers of the at least two auxiliary radiators are arranged at a horizontal lateral distance that is less than the lateral distance between the centers of the radiator groups or the radiators in the two antenna columns, the broadband radiators in a particular antenna column being jointly powered together with the at least one auxiliary radiator, and a distribution network provided for the at least one radiator group comprising the at least one associated radiator which has an associated filter function for the at least one associated auxiliary radiator, which network is designed such that the at least one broadband radiator transmits and/or receives in a broadband frequency band, and specifically at a center frequency that is lower than a comparatively higher frequency band or frequency sub-band having a center frequency which is transmitted and/or received by the relevant auxiliary radiator, wherein the comparatively higher frequency band or frequency sub-band that is received and/or transmitted via the relevant auxiliary radiator and which has a higher center frequency overlaps completely or only in part with the broadband frequency band having a comparatively lower center frequency.

2. Antenna array according to claim 1, wherein the filter is designed as a high-pass filter, a band-stop filter or a band-pass filter.

3. Antenna array according to claim 2, wherein the filter function in the form of a high-pass filter, a band-stop filter or a bandpass filter, comprises a matching circuit for matching the radiator impedance to a power supply network.

4. Antenna array according to claim 1, wherein the distribution network is constructed such that the amplitude distribution with respect to the at least one auxiliary radiator or the plurality of auxiliary radiators for the upper frequency range or frequency sub-range is evenly matched to the amplitude distribution of the broadband radiator with respect to the entire frequency range.

5. Antenna array according to claim 1, wherein the distribution network is constructed such that the at least one auxiliary radiator in each antenna column is powered or operated at an amplitude or power that is higher than that of the broadband radiators.

6. Antenna array according to claim 1, wherein the distribution network is constructed such that the at least one auxiliary radiator in each antenna column is powered or operated at an amplitude or power that is equal to or less than that of the broadband radiators.

7. Antenna array according to claim 1, wherein the broadband radiators in the at least two antenna columns are arranged so as to be offset in the same vertical position or in the vertical direction.

8. Antenna array according to claim 1, wherein the mechanical column distance between the center of two adjacent antenna columns is from 0.2λ, to 1.2λ, based on the center frequency of the broadband radiators for the entire frequency range.

9. Antenna array according to claim 1, wherein the broadband radiators are constructed such that they can transmit and/or receive in a frequency band of from 1650 MHz to 2900 MHz.

10. Antenna array according to claim 1, wherein the auxiliary radiators are constructed such that they can transmit and/or receive in a frequency band of from 2300 MHz to 2600 MHz.

11. Antenna array according to claim 1, wherein the broadband radiators are constructed such that they can transmit and/or receive in a frequency band of from 698 MHz to 960 MHz.

12. Antenna array according to claim 1, wherein the broadband radiators are designed such that they can be operated at a relative bandwidth of greater than 25%.

13. Antenna array according to claim 1, wherein the distribution network is formed on a printed board.

14. Antenna array according to claim 1, wherein the distribution network is formed by cables and filters.

15. Antenna array according to claim 1, wherein the antenna array comprises radiator groups and radiators which are formed so as to be the same, different and/or separate for the transmit mode and receive mode.

16. Antenna array according to claim 1, wherein the distribution network comprises adjustable phase shifters.

17. Antenna array for operating in a mobile communications frequency band, comprising:

first and second antenna columns oriented to extend at least predominantly in a vertical direction and positioned side by side in a horizontal direction;

a first broadband polarized radiator arranged in the first antenna column;

a second broadband polarized antenna arranged in the second antenna column, the first and second broadband polarized radiators being configured to transmit and/or receive polarized mobile communications frequency band signals in a broadband frequency band at a relative bandwidth of ≥25%;

a first auxiliary radiator provided in the first antenna column, a second auxiliary radiator provided in the second antenna column, the first and second auxiliary radiators being arranged such that centers of the first and second auxiliary radiators are arranged at a horizontal lateral distance that is less than a lateral distance between the centers of the first and second broadband polarized radiators in the first and second antenna columns; and at least one distribution network configuring the antenna array to achieve a substantially constant electrical radiator distance over the mobile communications frequency band while suppressing undesired side lobes by (1) jointly powering the first auxiliary radiator together with the first and second broadband radiators, (2) jointly powering the first and second auxiliary radiator together with the second broadband radiator, and (3) providing a filter function for the first auxiliary radiator that is associated with the first broadband polarized radiator such that the first broadband polarized radiator transmits and/or receives in the broadband frequency band having a center frequency that is lower than the center frequency of a comparatively higher frequency band or frequency sub-band which is transmitted or received by the first auxiliary radiator, the comparatively higher frequency band or frequency sub-band that is received and/or transmitted by the auxiliary radiator at least in part overlapping the broadband frequency band having a comparatively lower center frequency.

18. Antenna array for operating in a mobile communications frequency band, comprising:

first and second antenna columns oriented to extend at least predominantly in a vertical direction and positioned side by side in a horizontal direction;

a first broadband polarized radiator arranged in the first antenna column;

a second broadband polarized antenna arranged in the second antenna column, the first and second broadband polarized radiators being configured to transmit and/or receive polarized mobile communications frequency band signals in a broadband frequency band at a relative bandwidth of ≥25%;

a first auxiliary radiator provided in the first antenna column, a second auxiliary radiator provided in the second antenna column, the first and second auxiliary radiators being arranged such that centers of the first and second auxiliary radiators are arranged at a horizontal lateral distance that is less than a lateral distance between the centers of the first and second broadband polarized radiators in the first and second antenna columns; and distribution network means for configuring the antenna array to achieve a substantially constant electrical radiator distance over the mobile communications frequency band while suppressing undesired side lobes, the distribution network means for:

(1) jointly powering the first auxiliary radiator together with the first and second broadband radiators, (2) jointly powering the first and second auxiliary radiator together with the second broadband radiator, and (3) providing a filter function for the first auxiliary radiator that is associated with the first broadband polarized radiator such that the first broadband polarized radiator transmits and/or receives over the broadband frequency band having a center frequency that is lower than a comparatively higher frequency band or frequency sub-band having a center frequency which is transmitted or received by the first auxiliary radiator, the comparatively higher frequency band or frequency sub-band that is received and/or transmitted by the auxiliary radiator at least in part overlapping the broadband frequency band having a comparatively lower center frequency.

* * * * *